US011688569B2

(12) United States Patent
Skuci et al.

(10) Patent No.: US 11,688,569 B2
(45) Date of Patent: Jun. 27, 2023

(54) THREE-POSITION DISCONNECTOR SWITCH

(71) Applicant: ABB Schweiz AG, Baden (CH)

(72) Inventors: Michal Skuci, Brno (CZ); Josef Cernohous, Jamne nad Orlici (CZ); Radek Javora, Hrusovany u Brna (CZ); Tomas Kozel, Brno (CZ)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/740,876

(22) Filed: May 10, 2022

(65) Prior Publication Data

US 2022/0367132 A1 Nov. 17, 2022

(30) Foreign Application Priority Data

May 14, 2021 (EP) ..... 21173956

(51) Int. Cl.
*H01H 31/02* (2006.01)
*H01H 31/00* (2006.01)

(52) U.S. Cl.
CPC ..... *H01H 31/026* (2013.01); *H01H 31/003* (2013.01)

(58) Field of Classification Search
CPC .... H01H 31/026; H01H 31/003; H01H 3/264; H01H 1/20; H01H 1/36; H01H 9/20; H01H 9/0072; H01H 33/022
USPC ..... 200/48 R, 243; 218/43, 78–80, 93
See application file for complete search history.

(56) References Cited

U.S. PATENT DOCUMENTS

2006/0283842 A1* 12/2006 Pavlovic ..... H01H 31/003 218/79
2022/0115195 A1* 4/2022 Javora ..... H01H 31/26

FOREIGN PATENT DOCUMENTS

EP 3671789 A1 6/2020
EP 3754681 A1 12/2020

OTHER PUBLICATIONS

European Patent Office, Extended European Search Report in European Application No. 21173956.0, 5 pp. dated Nov. 9, 2021.

* cited by examiner

*Primary Examiner* — Edwin A. Leon
*Assistant Examiner* — Iman Malakooti
(74) *Attorney, Agent, or Firm* — Leydig, Voit & Mayer, Ltd.

(57) ABSTRACT

A switch includes a power in contact, a piston, a power out contact, a plurality of flexible locking elements, an earthing contact, and a threaded rod. In a first position, the piston contacts the power in contact and the power out contact. In a second position, the piston contacts the power out contact. In a third position, the piston contacts the earthing contact and the power out contact. The piston comprises an inner threaded section that engages the threaded rod. Rotation of the threaded rod moves the piston along an axis of the switch between the different switch positions. The piston comprises a groove extending in a direction parallel to the axis. Each of the flexible locking elements is configured such that a part of each of the flexible locking elements moves into and out of the groove as the piston is moved along the axis of the switch.

20 Claims, 2 Drawing Sheets

THREE-POSITION DISCONNECTOR SWITCH

CROSS-REFERENCE TO RELATED APPLICATIONS

Figure 1A:
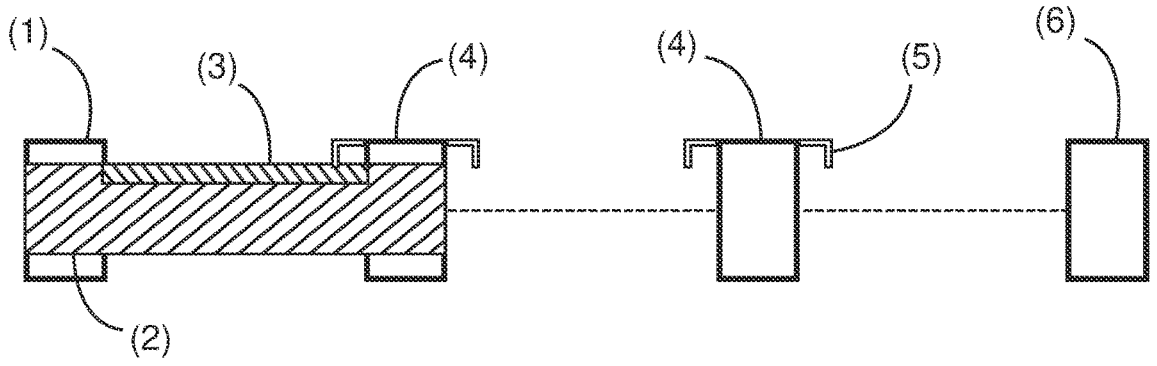

This patent application claims priority to European Patent Application No. 21173956.0, filed on May 14, 2021, which is incorporated herein in its entirety by reference.

FIELD OF THE DISCLOSURE

The present disclosure relates to a three-position disconnector switch and a switchgear or control gear for low voltage, medium voltage or high voltage use with a sub station.

BACKGROUND OF THE INVENTION

Three-position disconnectors are typically used to disconnect a panel from the main bus bars or to connect it to earth. For that, a linear three-position disconnector can be used. Such a disconnector can be propelled or moved in a number of different ways and can have many different shapes. A circular type can be propelled by a screw and provides many benefits but, must be locked in a rotational motion. There are different ways how to achieve this.

If a linear three-position disconnector is propelled by screw, the disconnector's piston is subjected not just to a linear force, but also to a torque. Rotation of the piston itself is unwanted and should be eliminated, otherwise it cannot for certain be determined if the piston has always reached its desired position. Rotation of the screw should therefore be completely transferred to a linear movement of the piston. Ideally, this should be done in a manner that does not make the three-position disconnector larger that it needs to be from a temperature rise and dielectric point of view. However, this is difficult to achieve.

BRIEF SUMMARY OF THE INVENTION

The present disclosure describes an improved three-position disconnector switch.

The object of the present invention is solved with the subject matter of the independent claims, wherein further embodiments are incorporated in the dependent claims.

In a first aspect, there is provided a three-position disconnector switch, comprising:

a power in contact;

a piston;

a power out contact;

a plurality of flexible locking elements;

an earthing contact; and a threaded rod.

A length of the piston is such that in a first switch position an outer surface of a wall of the piston makes an electrical contact between the power in contact and the power out contact. The length of the piston is such that in a second switch position the outer surface of the wall of the piston does not make an electrical contact with either the earthing contact or the power in contact.

In the second switch position the outer surface of the wall of the piston makes an electrical contact with the power out contact. The length of the piston is such that in a third switch position the outer surface of wall of the piston makes an electrical contact between the earthing contact and the power out contact. The piston comprises an inner threaded section configured to engage with the threaded rod, and rotation of the threaded rod is configured to engage with the inner threaded section to move the piston along an axis of the switch between the different switch positions.

The piston comprises a groove extending in a direction parallel to the axis. Each of the flexible locking elements is configured such that a part of each of the flexible locking elements moves into and out of the groove as the piston is moved along the axis of the switch between the different switch positions as the piston is moved in both directions along the axis. As the piston is moved along the axis the switch is configured such that there is always a part of at least one flexible locking element in the groove. When a part of at least one flexible locking element is in the groove the piston is constrained from rotating about the axis.

BRIEF DESCRIPTION OF THE SEVERAL VIEWS OF THE DRAWING(S)

Exemplary embodiments will be described in the following with reference to the following drawings.

Figure 1B:
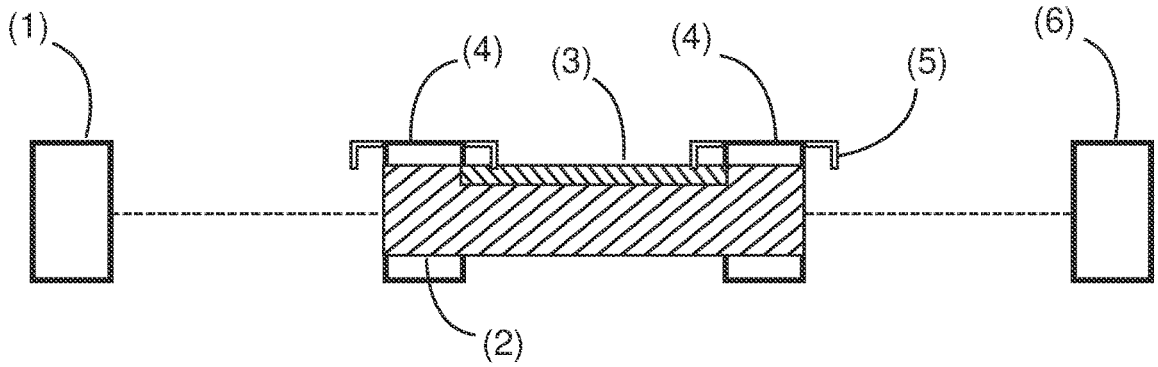
Figure 1C:
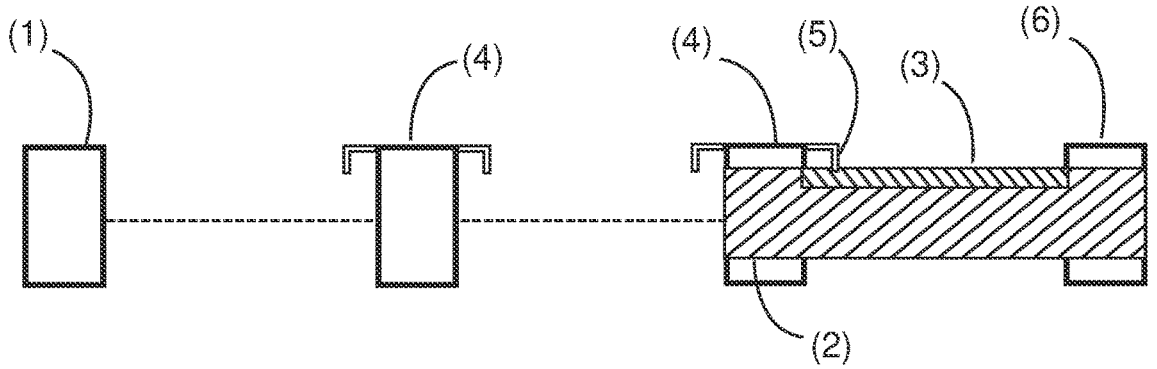

FIGS. 1A, 1B, and 1C show schematic representations of a three-position disconnector switch in accordance with the disclosure, in three different switch positions.

Figure 2:
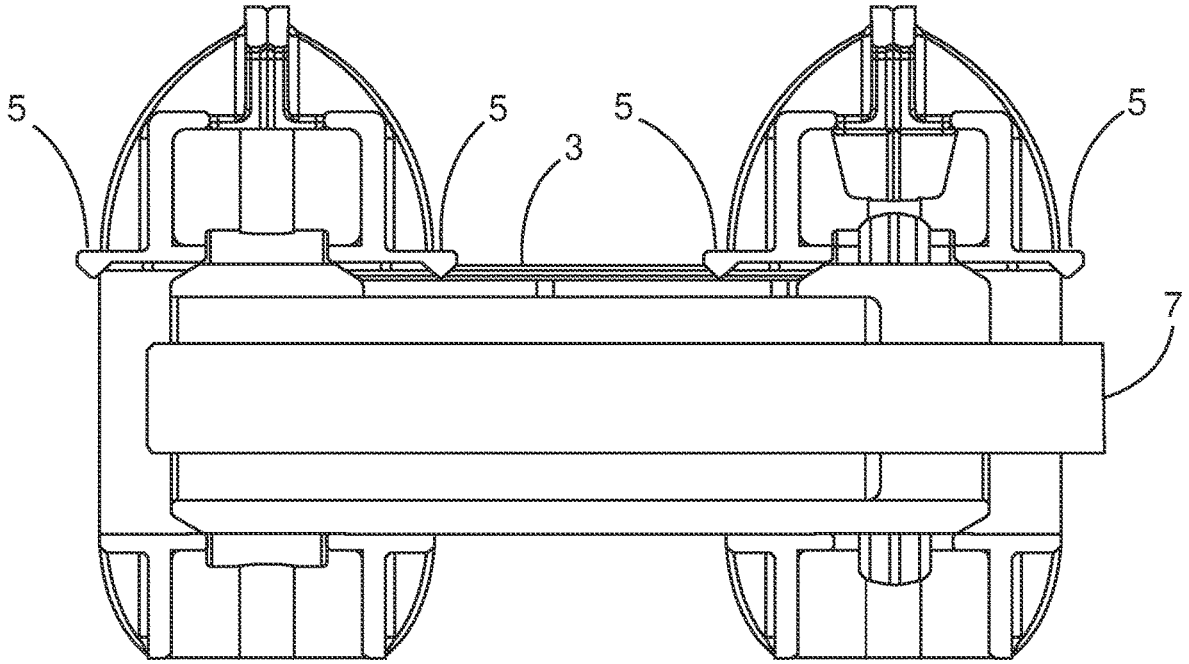

FIG. 2 shows a detailed representation of the middle or power out contact of a three-position disconnector switch in accordance with the disclosure.

DETAILED DESCRIPTION OF THE INVENTION

FIGS. 1A, 1B, 1C, and FIG. 2 relate to a new three-position disconnector switches in a number of different exemplar embodiments, where further specific exemplar embodiments are described below.

In an example, the three-position disconnector switch comprises a power in contact 1, a piston 2, a power out contact 4, a plurality of flexible locking elements 5, an earthing contact 6, and a threaded rod 7. A length of the piston is such that in a first switch position an outer surface of a wall of the piston makes an electrical contact between the power in contact and the power out contact. The length of the piston is such that in a second switch position the outer surface of the wall of the piston does not make an electrical contact with either the earthing contact or the power in contact.

In the second switch position the outer surface of the wall of the piston makes an electrical contact with the power out contact. The length of the piston is such that in a third switch position the outer surface of wall of the piston makes an electrical contact between the earthing contact and the power out contact. The piston comprises an inner threaded section configured to engage with the threaded rod. Rotation of the threaded rod is configured to engage with the inner threaded section to move the piston along an axis of the switch between the different switch positions.

The piston comprises a groove extending in a direction parallel to the axis. Each of the flexible locking elements is configured such that a part of each of the flexible locking elements moves into and out of the groove as the piston is moved along the axis of the switch between the different switch positions as the piston is moved in both directions along the axis. As the piston is moved along the axis the switch is configured such that there is always a part of at least one flexible locking element in the groove. When a part of at least one flexible locking element is in the groove the piston is constrained from rotating about the axis.

According to an example, each of the plurality of flexible locking elements is non-conducting.

According to an example, the power out contact comprises a first part and a second part. The first part is electrically connected to the second part. In the first switch position the outer surface of the wall of the piston makes a direct electrical contact with the first part of the power out contact and makes a direct electrical contact with the power in contact. In the second switch position the outer surface of the wall of the piston makes a direct electrical contact with the first part of the power out contact and makes a direct electrical contact with the second part of the power out contact. In the third switch position the outer surface of wall of the piston makes a direct electrical contact with the second part of the power out contact and makes a direct electrical contact with the earthing contact.

According to an example, a first flexible locking element (of the plurality of flexible locking elements) is connected to the power out contact and is on a side of the power out contact towards the power in contact and a second flexible locking element (of the plurality of flexible locking elements) is connected to the power out contact and is on a side of the power out contact towards the earthing contact.

According to an example, in the first switch position the part of the first flexible locking element is in the groove. In the second switch position the part of the first flexible locking element is in the groove and the part of the second flexible locking element is in the groove. In the third switch position the part of the second flexible locking element is in the groove.

According to an example, in the first switch position the part of the second flexible locking element is not to be in the groove, and in the third switch position the part of the first flexible locking element is not in the groove.

According to an example, the first flexible locking element is connected to the first part of the power out contact and is on a side of the first part of the power out contact towards the power in contact and the second flexible locking element is connected to the second part of the power out contact and is on a side of the second part of the power out contact towards the earthing contact. In the first switch position the part of the first flexible locking element is in the groove.

According to an example, in the first switch position the part of the second flexible locking element is not in the groove.

According to an example, a third flexible locking element (of the plurality of locking elements) is connected to the first part of the power out contact and is on a side of the first part of the power out contact towards the earthing contact and a fourth flexible locking element (of the plurality of flexible locking elements) is connected to the second part of the power out contact and is on a side of the second part of the power out contact towards the power in contact. In the second switch position the part of the third flexible locking element is in the groove and in the second switch position the part of the fourth flexible locking element is in the groove.

According to an example, the first flexible locking element is connected to the second part of the power out contact and is on a side of the second part of the power out contact towards the power in contact and the second flexible locking element is connected to the first part of the power out contact and is on a side of the first part of the power out contact towards the earthing contact. In the second switch position the part of the first flexible locking element is in the groove and the part of the second flexible locking element is in the groove.

According to an example, a third flexible locking element (of the plurality of flexible locking elements) is connected to the power in contact and is on a side of the power in contact towards the earthing contact and a fourth flexible locking element (of the plurality of flexible locking elements) is connected to the earthing contact and is on a side of the earthing contact towards the power in contact. In the first switch position the part of the third flexible locking element is in the groove and in the third switch position the part of the fourth flexible locking element is in the groove.

According to an example, in the first switch position the part of the second flexible locking element is not in the groove and in the third switch position the part of the first flexible locking element is not in the groove.

According to an example, the groove does not extend to a first distal end of the piston.

According to an example, the groove does not extend to a second distal end of the piston opposite to the first distal end.

In an example, an end of the groove at the first distal end and an end of the groove at the second distal end are sloped.

According to an example, the plurality of flexible locking elements are configured to flex.

In an example, the plurality of flexible locking elements are configured to flex such that the part of each flexible locking element moves substantially in a radial direction with respect to the axis of the switch.

In an example, the flexible locking elements are configured to flex in an arcuate manner.

From the above, it is clear that one or more three-position disconnectors as described can be utilized in a low voltage, medium voltage of high voltage switchgear or control gear, where for example three such disconnectors can be utilized one for each phase of a three-phase system.

Continuing with the new three-position disconnector switch, in its embodiments, the following relates to detailed specific embodiments.

FIGS. 1A, 1B, and 1C show a specific detailed embodiment of a new three position disconnector switch. FIG. 1A shows to disconnector switch in a first switch position. FIGS. 1B and 1C show the switch in second and third positions, respectively. The path of a piston 2 in these figures is denoted by dashed lines connecting the contacts. The piston 2 is at the left-hand position, and connects a bus bar contact 1, also called a power in contact, to a left-hand part of middle contact 4, also referred to as a first part of a power out contact. The power out contact 4 actually has two parts, and flexible locking elements 5 extend either side of each part of the power out contact 4. The piston 2 has a groove 3 and one of the flexible locking elements 5 is located in the groove and stops the piston from rotating about an axis of the switch. The center of the piston is threaded, and a screw thread 7 extends along the axis and rotation of the screw thread moves the piston along the axis, because it cannot rotate. The screw thread 7 is shown in FIG. 2.

In FIG. 1B, the piston is shown in a second switching position, where the piston is contacting both parts of the middle or power out contact 4. Here, two flexible locking elements are located in the groove, stopping the piston from rotating axially. FIG. 1C shows the piston in the third switch position, where it connects the right hand part or second part of the power out contact 4 with an earth or earthing contact 6, and here one flexible locking element is located in the groove stopping the piston from rotating axially.

As the screw thread rotates and drives the piston through the different switch positions, there is always at least one flexible locking element located in the groove. It is to be noted that FIG. 1B shows a detailed view of the middle or power out contact, with the piston connecting both parts together, and where to flexible locking elements have parts located in the groove of the piston stopping the piston from rotating axially. As shown, the groove has sloping ends, and indeed the ends of the piston sloping. This means as the sloping end of the groove or sloping end of the piston meets a flexible locking element, it gradually pushes it outwards from the groove onto the top of the piston, or when the piston first encounters the flexible locking element, pushes the flexible locking element onto the top of the piston and then when the groove is encountered, the flexible locking element flex downwards into the groove.

Thus, returning to FIG. 1A, in the first switching position, operation of the switch begins with a part of one flexible locking element being located in the groove. As the piston is driven to the right from the first switching position (FIG. 1A) to the second switching position (FIG. 1B), a second flexible locking element is encountered and pushed upwards onto the top of the piston and then as the piston further moves to the right the second flexible locking element flexes downwards into the groove, and then as the piston continues to the right the first flexible locking element encounters the left-hand end of the groove and is pushed upwards onto the top of the piston out of the groove and then as the piston further moves to the right this first flexible locking element flexes downwards when the piston has passed. Also, in moving to the right a third flexible locking element is encountered that extends from the left-hand side of the second part of the power out contact, and again is pushed outwards and then flexes downwards into the groove. Thus, in the second switching position the second and third flexible locking elements are located in the groove, as shown in FIG. 1B. Then as the piston continues to be driven to the right, towards the third switching position shown in FIG. 1C, the second flexible locking element exits the groove, and a fourth flexible locking element enters the groove, where at an intermediate stage there are two flexible locking elements in the groove, and finally when the piston is driven all the way to the third switching position only the fourth flexible locking element remains in the groove.

However, at all times at least one flexible locking element has remained in the groove, stopping the piston from rotating axially as it is driven through rotation of the thread.

Thus, by making the locking element flexible allows to the groove to be located on the piston partly somewhere in the middle section and the groove need not go all the way across the top of the piston and be open at the ends. Plastic covers/bearings can be utilized in which the flexible locking element is incorporated. It can be made in several pieces located on each part of the middle contact. This arrangement provides rotational locking along the whole way of the travel of the disconnector piston. Non-conductivity of the flexible locking elements means it doesn't shorten the air gap between middle contact and bus bar or earth contact. Additional advantage of this setup is that the groove can be made outside of the contact area on the disconnector piston and thus it doesn't compromise contact performance. Additionally, because the groove is only in the middle section there are no sharp edges on the ends of the piston, which helps the dielectric performance and decrease the necessary length of the air gap. And finally using four flexible elements allows for the shortest piston possible while having the piston locked against rotation along the whole travel distance way (the piston need to have a length only from contact to contact).

Overall this setup provides the most space and material effective solution.

Thus the new technology provides sets of flexible locking elements that slide/flex to a groove on the disconnector piston made somewhere in the middle section of the piston. Locking elements are located on the middle contact in a way that ensures that the disconnector piston is locked against rotation along the whole travel of the piston. This setup provides the most space efficient solution.

However, a slightly different arrangement of flexible locking elements can be utilized. Here, rather than the 2 outer flexible locking elements as described above being connected to the first and second parts of the middle or power out contact 4, these can be transferred to the power in contact 1 and the earthing contact 6, and face inwards. The operation of the disconnector switch is very much as described above with respect to FIGS. 1A-1C, and FIG. 2, where there is always at least one flexible locking element located within the groove stopping the piston rotating axially as it is driven from one position to the next. In this arrangement, the flexible locking elements that have been taken from the middle contact and have now been put on the power in unearthing contacts need to be longer than they were previously, and this can lead to a decrease in dielectric performance. However, in certain situations this embodiment can be utilized if there are constraints regarding utilization of the previously described embodiment.

In an example, each of the plurality of flexible locking elements is non-conducting.

In an example, the power out contact comprises a first part and a second part. The first part is electrically connected to the second part. In the first switch position the outer surface of the wall of the piston makes a direct electrical contact with the first part of the power out contact and makes a direct electrical contact with the power in contact. In the second switch position the outer surface of the wall of the piston makes a direct electrical contact with the first part of the power out contact and makes a direct electrical contact with the second part of the power out contact. In the third switch position the outer surface of wall of the piston makes a direct electrical contact with the second part of the power out contact and makes a direct electrical contact with the earthing contact.

Thus, the middle power out contact is made in two parts, that are electrically connected to each other. This leads to a reduction in the overall length of the disconnector switch with respect to a disconnector switch with only one middle power out contact.

In an example, a first flexible locking element is connected to the power out contact and is on a side of the power out contact towards the power in contact and a second flexible locking element is connected to the power out contact and is on a side of the power out contact towards the earthing contact.

In an example, in the first switch position the part of the first flexible locking element is in the groove. In the second switch position the part of the first flexible locking element is in the groove and the part of the second flexible locking element is in the groove. In the third switch position the part of the second flexible locking element is in the groove.

In an example, in the first switch position the part of the second flexible locking element is not to be in the groove. In the third switch position the part of the first flexible locking element is not in the groove.

In other words, the switch can have a middle or power out contact that is in the form of only one contact, with flexible locking elements extending out from either side of the contact.

In an example, the first flexible locking element is connected to the first part of the power out contact and is on a side of the first part of the power out contact towards the power in contact and the second flexible locking element is connected to the second part of the power out contact and is on a side of the second part of the power out contact towards the earthing contact. In the first switch position the part of the first flexible locking element is in the groove.

In other words, the disconnector switch has a middle power out contact with two contact parts and a flexible locking element is on each part facing outwards away from each other.

In an example, in the first switch position the part of the second flexible locking element is not in the groove.

In an example, a third flexible locking element is connected to the first part of the power out contact and is on a side of the first part of the power out contact towards the earthing contact and a fourth flexible locking element is connected to the second part of the power out contact and is on a side of the second part of the power out contact towards the power in contact. In the second switch position the part of the third flexible locking element is in the groove and in the second switch position the part of the fourth flexible locking element is in the groove.

Thus, the disconnector arrangement has a middle power out connector having two parts, and flexible locking elements are on both sides of each part.

In this manner, there can always be a part of at least one locking element in the groove, whilst at the same time the length of the piston and the length of the groove can be minimized.

In an example, the first flexible locking element is connected to the second part of the power out contact and is on a side of the second part of the power out contact towards the power in contact and the second flexible locking element is connected to the first part of the power out contact and is on a side of the first part of the power out contact towards the earthing contact. In the second switch position the part of the first flexible locking element is in the groove and the part of the second flexible locking element is in the groove.

In other words, the disconnector switch has a middle power out contact with two contact parts and a flexible locking element is on each part facing inwards towards each other.

In an example, a third flexible locking element is connected to the power in contact and is on a side of the power in contact towards the earthing contact and a fourth flexible locking element is connected to the earthing contact and is on a side of the earthing contact towards the power in contact. In the first switch position the part of the third flexible locking element is in the groove and in the third switch position the part of the fourth flexible locking element is in the groove.

Thus, the power in and earthing connectors also have flexible locking elements facing inwards.

In this manner, there can always be a part of at least one locking element in the groove, whilst at the same time the length of the piston and the length of the groove can be minimized.

In an example, in the first switch position the part of the second flexible locking element is not in the groove and in the third switch position the part of the first flexible locking element is not in the groove.

In an example, the groove does not extend to a first distal end of the piston, and optionally wherein the groove does not extend to a second distal end of the piston opposite to the first distal end.

Thus, sharp ends or corners do not compromise the dielectric performance.

In an example, the plurality of flexible locking elements are configured to flex.

In a second aspect there is provided a low voltage, medium voltage of high voltage switchgear or control gear comprising one or more three-position disconnector switches according to the first aspect.

The above aspect and examples will become apparent from and be elucidated with reference to the embodiments described hereinafter.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A three-position disconnector switch, comprising:

a power in contact;

a piston;

a power out contact;

a plurality of flexible locking elements;

an earthing contact; and a threaded rod;

wherein a length of the piston is such that in a first switch position an outer surface of a wall of the piston makes an electrical contact between the power in contact and the power out contact;

wherein the length of the piston is such that in a second switch position the outer surface of the wall of the piston does not make an electrical contact with either the earthing contact or the power in contact, and wherein in the second switch position the outer surface of the wall of the piston makes an electrical contact with the power out contact;

wherein the length of the piston is such that in a third switch position the outer surface of wall of the piston makes an electrical contact between the earthing contact and the power out contact;

wherein the piston comprises an inner threaded section configured to engage with the threaded rod, and wherein rotation of the threaded rod is configured to engage with the inner threaded section to move the piston along an axis of the switch between the different switch positions;

wherein the piston comprises a groove extending in a direction parallel to the axis;

wherein each of the flexible locking elements is configured such that a part of each of the flexible locking elements moves into and out of the groove as the piston is moved along the axis of the switch between the different switch positions as the piston is moved in both directions along the axis;

wherein, as the piston is moved along the axis the switch is configured such that there is always a part of at least one flexible locking element in the groove; and wherein when a part of at least one flexible locking element is in the groove the piston is constrained from rotating about the axis.

2. The three-position disconnector switch according to claim 1, wherein each of the plurality of flexible locking elements is non-conducting.

3. The three-position disconnector switch according to claim 1, further comprising:

wherein the power out contact comprises a first part and a second part, wherein the first part is electrically connected to the second part, wherein, in the first switch position the outer surface of the wall of the piston makes a direct electrical contact with the first part of the power out contact and makes a direct electrical contact with the power in contact, wherein, in the second switch position the outer surface of the wall of the piston makes a direct electrical contact with the first part of the power out contact and makes a direct electrical contact with the second part of the power out contact, and wherein, in the third switch position the outer surface of wall of the piston makes a direct electrical contact with the second part of the power out contact and makes a direct electrical contact with the earthing contact.

4. The three-position disconnector switch according to claim 3, wherein a first flexible locking element is connected to the power out contact and is disposed on a side of the power out contact towards the power in contact, and wherein a second flexible locking element is connected to the power out contact and is disposed on a side of the power out contact towards the earthing contact.

5. The three-position disconnector switch according to claim 4, wherein, in the first switch position, the part of the first flexible locking element is disposed in the groove, wherein, in the second switch position, the part of the first flexible locking element is disposed in the groove and the part of the second flexible locking element is disposed in the groove, and wherein, in the third switch position, the part of the second flexible locking element is disposed in the groove.

6. The three-position disconnector switch according to claim 5, wherein, in the first switch position, the part of the second flexible locking element is not disposed in the groove, and wherein, in the third switch position, the part of the first flexible locking element is not disposed in the groove.

7. The three-position disconnector switch according to claim 4, wherein the first flexible locking element is connected to the first part of the power out contact and is disposed on a side of the first part of the power out contact towards the power in contact, wherein the second flexible locking element is connected to the second part of the power out contact and is disposed on a side of the second part of the power out contact towards the earthing contact, and wherein, in the first switch position, the part of the first flexible locking element is disposed in the groove.

8. The three-position disconnector switch according to claim 7, wherein, in the first switch position, the part of the second flexible locking element is not disposed in the groove.

9. The three-position disconnector switch according to claim 7, wherein a third flexible locking element is connected to the first part of the power out contact and is disposed on a side of the first part of the power out contact towards the earthing contact, and a fourth flexible locking element is connected to the second part of the power out contact and is disposed on a side of the second part of the power out contact towards the power in contact, and wherein, in the second switch position the part of the third flexible locking element is disposed in the groove, and in the second switch position the part of the fourth flexible locking element is disposed in the groove.

10. The three-position disconnector switch according to claim 4, wherein the first flexible locking element is connected to the second part of the power out contact and is disposed on a side of the second part of the power out contact towards the power in contact, and the second flexible locking element is connected to the first part of the power out contact and is disposed on a side of the first part of the power out contact towards the earthing contact, and wherein, in the second switch position the part of the first flexible locking element is disposed in the groove and the part of the second flexible locking element is disposed in the groove.

11. The three-position disconnector switch according to claim 10, wherein a third flexible locking element is connected to the power in contact and is disposed on a side of the power in contact towards the earthing contact, and a fourth flexible locking element is connected to the earthing contact and is disposed on a side of the earthing contact towards the power in contact, and wherein, in the first switch position, the part of the third flexible locking element is disposed in the groove, and wherein, in the third switch position, the part of the fourth flexible locking element is disposed in the groove.

12. The three-position disconnector switch according to claim 11, wherein, in the first switch position, the part of the second flexible locking element is not disposed in the groove, and wherein, in the third switch position, the part of the first flexible locking element is not disposed in the groove.

13. The three-position disconnector switch according to claim 1, wherein the groove does not extend to a first distal end of the piston.

14. The three-position disconnector switch according to claim 13, wherein the groove does not extend to a second distal end of the piston, the second distal end being opposite to the first distal end.

15. The three-position disconnector switch according to claim 1, wherein each of the plurality of flexible locking elements is configured to flex.

16. A device, the device being a low voltage, medium voltage or high voltage switchgear, or a control gear, the device comprising one or more three-position disconnector switches, each of the one or more disconnector switches comprising:

a power in contact;

a piston;

a power out contact;

a plurality of flexible locking elements;

an earthing contact; and a threaded rod;

wherein a length of the piston is such that in a first switch position an outer surface of a wall of the piston makes an electrical contact between the power in contact and the power out contact;

wherein the length of the piston is such that in a second switch position the outer surface of the wall of the piston does not make an electrical contact with either the earthing contact or the power in contact, and wherein in the second switch position the outer surface of the wall of the piston makes an electrical contact with the power out contact;

wherein the length of the piston is such that in a third switch position the outer surface of wall of the piston makes an electrical contact between the earthing contact and the power out contact;

wherein the piston comprises an inner threaded section configured to engage with the threaded rod, and wherein rotation of the threaded rod is configured to engage with the inner threaded section to move the piston along an axis of the switch between the different switch positions;

wherein the piston comprises a groove extending in a direction parallel to the axis;

wherein each of the flexible locking elements is configured such that a part of each of the flexible locking elements moves into and out of the groove as the piston is moved along the axis of the switch between the different switch positions as the piston is moved in both directions along the axis;

wherein, as the piston is moved along the axis the switch is configured such that there is always a part of at least one flexible locking element in the groove; and wherein when a part of at least one flexible locking element is in the groove the piston is constrained from rotating about the axis.

17. The device according to claim 16, wherein the power out contact comprises a first part and a second part, wherein the first part is electrically connected to the second part, wherein, in the first switch position the outer surface of the wall of the piston makes a direct electrical contact with the first part of the power out contact and makes a direct electrical contact with the power in contact, wherein, in the second switch position the outer surface of the wall of the piston makes a direct electrical contact with the first part of the power out contact and makes a direct electrical contact with the second part of the power out contact, and wherein, in the third switch position the outer surface of wall of the piston makes a direct electrical contact with the second part of the power out contact and makes a direct electrical contact with the earthing contact.

18. The device of claim 17, wherein a first flexible locking element is connected to the power out contact and is disposed on a side of the power out contact towards the power in contact, and wherein a second flexible locking element is connected to the power out contact and is disposed on a side of the power out contact towards the earthing contact.

19. The device according to claim 18, wherein, in the first switch position, the part of the first flexible locking element is disposed in the groove, wherein, in the second switch position, the part of the first flexible locking element is disposed in the groove and the part of the second flexible locking element is disposed in the groove, and wherein, in the third switch position, the part of the second flexible locking element is disposed in the groove.

20. The device according to claim 19, wherein, in the first switch position, the part of the second flexible locking element is not disposed in the groove, and wherein, in the third switch position, the part of the first flexible locking element is not disposed in the groove.

* * * * *